United States Patent [19]

Wixon

[11] 3,997,453

[45] Dec. 14, 1976

[54] SOFTENER DISPERSION

[75] Inventor: Harold E. Wixon, New Brunswick, N.J.

[73] Assignee: Colgate-Palmolive Company, New York, N.Y.

[22] Filed: July 11, 1975

[21] Appl. No.: 595,104

Related U.S. Application Data

[63] Continuation-in-part of Ser. No. 441,587, Feb. 11, 1974, abandoned, which is a continuation of Ser. No. 250,427, May 4, 1972, abandoned.

[52] U.S. Cl. ..... 252/8.75; 252/8.8; 252/547; 252/DIG. 14

[51] Int. Cl.[2] ..... D06M 13/32; D06M 13/46

[58] Field of Search ..... 252/8.75, 8.8, 547, 252/DIG. 14

[56] References Cited

UNITED STATES PATENTS

| | | | |
|---|---|---|---|
| 2,746,928 | 5/1956 | Darragh et al. | 252/106 |
| 2,877,186 | 3/1959 | Krumrel | 252/539 X |
| 2,978,416 | 4/1961 | Fein et al. | 252/558 X |
| 3,044,962 | 7/1962 | Brunt et al. | 252/8.8 |
| 3,122,502 | 2/1964 | Waldman | 252/8.8 |
| 3,303,136 | 2/1967 | Bright | 252/539 |
| 3,325,404 | 6/1967 | Cohen et al. | 252/8.8 X |
| 3,579,456 | 5/1971 | Cambre | 252/523 X |
| 3,600,385 | 8/1971 | Loffelman et al. | 260/240 |
| 3,630,895 | 12/1971 | Krause et al. | 252/8.75 |
| 3,644,204 | 2/1972 | Heins et al. | 252/8.8 |
| 3,660,286 | 5/1972 | Sepulveda et al. | 252/8.8 |
| 3,681,241 | 8/1972 | Rudy | 252/8.8 X |
| 3,697,423 | 10/1972 | Sundby et al. | 252/8.75 X |
| 3,700,607 | 10/1972 | Sundby et al. | 252/547 X |
| 3,703,480 | 11/1972 | Grand et al. | 252/8.75 X |
| 3,809,646 | 5/1974 | Spence | 252/8.8 |
| 3,813,349 | 5/1974 | Wolfson | 252/526 |
| 3,817,871 | 6/1974 | Graff | 252/8.8 |

*Primary Examiner*—Murray Tillman
*Assistant Examiner*—T. De Benedictis, Sr.
*Attorney, Agent, or Firm*—Norman Blumenkopf; Herbert S. Sylvester; Murray M. Grill

[57] ABSTRACT

Stable, fabric softening compositions having improved dispersibility in cold water are provided comprising a cationic quaternary ammonium softener as the sole fabric softening agent and an organic, anionic sulfonate, the weight ratio of cationic softener to anionic sulfonate being from about 80:1 to 3:1 and preferably 50:1 to 4:1 and more preferably 40:1 to 5:1. The presence of the cationic softener material in the described excess quantities assures a softening composition in the form of a stable, opaque, homogeneous liquid which is readily dispersible in water and having excellent softening properties with respect to various types of textile products.

9 Claims, No Drawings

SOFTENER DISPERSION

RELATED APPLICATIONS

This application is a continuation-in-part of U.S. application Ser. No. 441,587 filed Feb. 11, 1974, entitled "ANIONIC SURFACTANT AS AID TO CATIONIC SOFTENER DISPERSION" in the name of H. E. Wixon now abandoned, which in turn is a continuation of Ser. No. 250,427 filed on May 4, 1972, now abandoned.

BACKGROUND OF THE INVENTION

1. Field of the Invention

The present invention relates to a stable fabric softening composition having improved dispersibility in cold water, comprising a cationic quaternary fabric softener, preferably an imidazolinium compound, and a minor amount of an aliphatic or an aromatic or alkyl substituted aromatic sulfonate as the dispersion aid.

2. Description of the Prior Art

The use of various and diverse chemical materials and particularly cationic quaternary ammonium compounds as softeners for textile products is very well known in the art. It is also well known to employ such materials for their softening effect during the laundering operation and particularly in the rinse cycle of the laundering process. This technique has been necessitated by the fact that the softeners heretofore employed, being mainly cationic in nature, are not compatible with the major type of detergent used in the washing cycle. By far, the predominating type of detergent used in home laundering processes is anionic in nature. It has been found that even traces of anionic materials results in a precipitate which greatly reduces the effectiveness of said cationic fabric softeners. This manifestation of incompatibility has necessitated the use of cationic quaternary softeners during laundering in the rinse cycle after several rinses to free said laundered fabrics of traces of anionic detergent.

Another disadvantage of the cationic fabric softeners is that many of them form viscous and/or gelatinous water dispersions which disperse with difficulty in warm or cold water. This slow dispersibility and said gelatinous particles may cause fabric staining and uneven softening. The extent of these undesirable effects depends on the water temperature, the amount of water and clothes, degree of agitation, and the consistency of the liquid softener. These undesirable effects, namely, uneven softening and staining, are particularly evident when adding viscous solutions to cold water or lukewarm water which is preferably used in the rinsing bath. In addition, a viscous product that is not readily pourable and/or water dispersible is a great inconvenience to the housewife.

It has now been found that the addition of a minor amount of an aliphatic or an aromatic or alkyl substituted aromatic sulfonate to cationic quaternary softening agents reduces the viscosity thereof and produces an opaque, homogeneous liquid which is readily dispersible in cold without adversely effecting the physical stability of said liquid or causing any loss in softening performance thereof.

OBJECTS OF THE INVENTION

Accordingly, a primary object of this invention is the provision of a cationic quaternary fabric softening composition possessing excellent cold water dispersibility.

Another object of this invention is to provide a fluid, stable, cationic quaternary fabric softening composition devoid of fabric staining.

Still another object of this invention is to provide a fluid, stable, cationic quaternary fabric softening compound possessing uniform softening properties.

Other objects and advantages of this invention will be readily apparent from the detailed description that follows.

DETAILED DESCRIPTION OF INVENTION

The foregoing objects are attained in accordance with the invention which in its broader aspects provides a stable, cold water dispersible fabric softening composition comprising as the sole softening agent, a cationic, quaternary ammonium compound, and an organic, anionic sulfonate, the weight ratio of said cationic softener to said anionic sulfonate being from about 80:1 to 3:1 and wherein said anionic sulfonate comprises at least one member selected from the group consisting of:

1. An unsubstituted benzene or naphthalene sulfonate, and mixtures thereof.
2. A mono-$C_1$ to $C_{20}$ alkyl substituted benzene or naphthalene sulfonate and mixtures thereof.
3. A polyalkyl substituted aromatic sulfonate with one alkyl group having a maximum of 18 carbons and each of the remaining alkyl groups having a maximum of 2 carbons, and mixtures thereof, and
4. Olefin and paraffin sulfonates containing from about 8 to 20 carbon atoms, and mixtures thereof and mixtures of the foregoing.

The cationic quaternary softening agents found useful in instant invention are commercially known and include quaternary ammonium compounds wherein typically at least one of the groups linked to the nitrogen atom is a higher alkyl group containing at least 12 carbon atoms and two or three of the groups linked to the nitrogen atom are lower alkyl or substituted alkyl groups which contain 1 to 6 carbon atoms, one or more of said lower alkyl groups may bear an aryl substituent or may be replaced by an aryl group such as a benzyl group, and there is present an anion such as halogen, acetate, methosulfate, etc. Typical quaternary ammonium compounds are ethyl-dimethyl-stearyl ammonium chloride, cetyl-dimethyl-benzyl ammonium chloride, dimethyl distearyl ammonium chloride, benzyl-dimethyl-stearyl ammonium chloride, benzyl-dimethyl-stearyl ammonium bromide, trimethyl-stearyl ammonium chloride, trimethyl-cetyl ammonium bromide, diethyl-distearyl ammonium chloride, diethyl-octyl-stearyl ammonium chloride, dimethyl-ethyl-lauryl ammonium chloride, dimethyl-methyl-ethyl-lauryl-cetyl ammonium chloride, ditallowdimethyl ammonium chloride, propyl-myristyl ammonium chloride, and the corresponding methosulfates, acetates, etc.

A preferred group of cationic quaternary ammonium softening agents are the imidazolinium salts, such as:

2-heptadecyl-1-methyl-1-[(2-stearoylamido)ethyl]-imidazolinium methyl sulfate, 2-heptadecyl-1-methyl-1-[(2-stearoylamido)ethyl]-imidazolinium chloride, 2-coco-1-(2-hydroxyethyl)-1-benzyl imidazolinium chloride, 2-coco-1-(hydroxyethyl)-1-(4-chlorobutyl-)imidazolinium chloride, 2-coco-1-(2-hydroxyethyl)-1-octadecenyl imidazolinium chloride,
2-tall oil fatty-1-(2-hydroxyethyl)-1-benzyl imidazolinium chloride,
2-tall oil fatty-1-(2-hydroxyethyl)-1-(4-chlorobutyl-)imidazolinium chloride,
2-heptadecenyl-1-(2-hydroxyethyl)-1-(4-chlorobutyl-)imidazolinium chloride,
2-heptadecenyl-1-(2-hydroxyethyl)-1-benzyl imidazolinium chloride,
2-heptadecyl-1-(hydroxyethyl)-1-octadecyl imidazolinium ethyl sulfate.

Other known imidazolinium salts possessing softening properties may be utilized herein.

General formulae for the cationic quaternary ammonium compounds useful herein are:

(1) 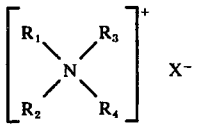

and (2) 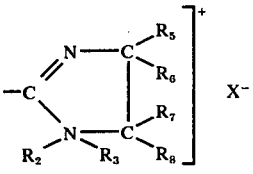

wherein R, is $C_8$ to $C_{22}$ aliphatic radical, preferably alkyl or alkenyl;

$R_2$ is $R_1$; $C_1$ to $C_6$ alkyl; aryl (e.g., phenyl, toluyl, xylyl, ethylphenyl, cumyl etc.); aralkyl (e.g., benzyl, phenethyl, methylbenzyl, etc.); $C_8$ to $C_{22}$ aliphatic amido $C_2$-$C_6$ alkyl (e.g., stearylamidoethyl, oleyl amido propyl, oleyl amidoethyl, etc.); $R_3$ and $R_4$ are independtly $C_1$ to $C_6$ alkyl; substituted $C_2$ to $C_6$ alkyl such as hydroxy $C_2$ to $C_6$ alkyl (e.g., 2-hydroxyethyl, 3-hydroxypropyl, 6-hydroxyhexyl etc.); halo $C_2$ to $C_6$ alkyl (e.g., 2-chloroethyl, 2-bromoethyl, 3-chloro-n-propyl, 2-chloroisopropyl, 6-chloroethyl, 5-bromohexyl, etc.); X is a water solubilizing anion such as chloride, bromide, iodide, fluoride, sulfate, methylsulfate, ethylsulfate, nitrite nitrate, phosphate $C_2$–$C_{22}$ carboxylate (e.g., acetate adipate, phthalate, benzoate, oleate, palmitate, stearate, licosanate, etc.).

The sulfonates useful in instant invention include:

1. An unsubstituted, benzene or naphthalene sulfonate,
2. A mono-$C_1$ to $C_{20}$ alkyl substituted benzene or naphthalene sulfonate.
3. A polyalkyl substituted aromatic sulfonate with one alkyl group having a maximum of 18 carbons and each of the remaining alkyl groups having a maximum of 2 carbons.
4. $C_8$ to $C_{20}$ olefin sulfonates and $C_8$ to $C_{20}$ paraffin sulfonates, and mixtures of the foregoing. Although the said one alkyl group may contain a maximum of 18 carbons, the lower alkyl radicals containing 1–6 carbons are preferred. Examples of useful benzene and naphthalene sulfonates include sodium benzene sulfonate, sodium toluene sulfonate, sodium xylene sulfonate, sodium cumene sulfonate, sodium linear tridecyl benzene sulfonate, sodium hexyl benzene sulfonate, sodium ethyl benzene sulfonate, sodium hexyl naphthalene sulfonate, etc., and mixtures thereof. Although the sodium salts have been specifically cited above, other water-soluble salts can be utilized herein, such as the potassium, ammonium, lower amine and alkanolamine salts of the sulfonates.

The incompatibility of even traces of anionics, such as the alkyl aryl, and alkyl aryl sulfonates, with cationic quaternary ammonium softeners is well known in the art. However, it has been found that the addition of minor amounts of the aforesaid sulfonates to water dispersions containing the stated excess of quaternary softener significantly reduces the viscosity of said dispersions and produces a homogeneous liquid which is readily dispersible in cold water. On a percentage basis, the liquid softener compositions described herein contain from about 0.4 to 5% of the anionic sulfonate detergent and from about 6 to about 25% of the cationic softener material, the balance being primarily water. The amount of organic anionic sulfonate additive is insufficient to cause significant loss of softening performance due to cationic-anionic reaction. Amounts as low as 0.4% sulfonate have been found to effectively reduce the viscosity of water dispersions of the cationic quaternary and to render said composition readily dispersible in cold water. Larger amounts up to about 5.0% have also been used advantageously. The concentration may be varied within the range of about 0.4 to 5.0% sulfonate, to attain maximum softness and maximum dispersibility in cold water, as well as over a wide temperature range.

However, the amount of anionic sulfonate should be insufficient to cause significant cationic-anionic interaction. In addition to reduced viscosity and enhanced cold water dispersibility, the composition comprising the anionic sulfonate and the cationic quaternary compound retains its stability and homogeneity as a liquid.

Other organic, anionic detergens of the sulfonate type useful herein either alone or in combination with the benzene and naphthalene sulfonate derivatives previously described are the olefin and paraffin sulfonates containing from about 8 to 20 carbon atoms. Olefin sulfonates include the long-chain alkene sulfonates, long chain hydroxyalkane sulfonates or mixtures of these materials. Such compounds may be prepared in known manner by the reaction of $SO_3$ with long chain olefins containing preferably from about 8 to 20 carbon atoms, and preferably from 12 to 20 carbon atoms and having the formula $RCH{=}CHR_1$ wherein R is a higher alkyl group of 6 to 23 carbons and $R_1$ is an alkyl of 1 to 17 carbons or hydrogen to form a mixture of sultones and alkenesulfonic acids which is then treated to convert the sultones to sulfonates. Paraffin sulfonates useful herein include for example the primary paraffin sulfonates made by reacting long chain alpha olefins and bisulfites and paraffin sulfonates having the sulfonate groups distributed along the paraffin chain as described in, for example, U.S. Pat. Nos. 2,503,280; 2,507,088; 3,260,741 and 3,372,188, which are incorporated by reference herein.

The following examples are given to further illustrate this invention. All parts are by weight unless otherwise indicated.

EXAMPLE 1

To 100 gms of a liquid softener containing 9.5% of a 75% solution of 2-heptadecyl-1-methyl-1[(2-stearoylamido)ethyl] imidazolinium methyl sulfate (7.1%), 0.28%* Calcofluor CSL brightener and 1.5% of a 1% solution of Acid Blue No. 80 is added 1 g of a 40% solution of sodium xylene sulfonate (0.4% by weight of the composition). The resultant liquid is opaque and homogeneous, light blue in color, and the viscosity is reduced considerably from that of the cationic quaternary per se.

*-4,4'bis(4-anilino-6-[N-(2-hydroxyethyl)-N-(2-carbamoyl ethyl-)amino]-s-triazin-2-ylamino)-2,2 stilbene disulfonic acid.

This composition is poured into 1000 ml of still water at 44° F. It disperses as a cloud which expands to fill the volume, thereby exhibiting excellent cold water dispersibility. The cationic softener per se produces gelatinous streamers when added to the still water at 44° F., which do not disperse spontaneously but require agitation. About 2g of cationic softener is present in the water.

10g of this composition is towel tested for softening properties in a rinse cycle containing tap water at 72° F. After air-drying, the towel is rated for softness on a scale of 1, which represents no softening, to 10, which is excellent softness. This towel is also rated as to whiteness on a *b* scale, the greater values signifying less whiteness. A towel treated with this composition is rated 10+ for softness, as compared to 10+ for the cationic softener per se, and rater +2.0 on the *b* scale for whiteness, as compared to +1.8 for the cationic softener per se. Thus, it is apparent that the sulfonate additive does not adversely affect the softening and the whitening properties of the cationic softener (the difference in a *b* value of +1.8 to 2.0 being substantially inconsequential as to whiteness).

EXAMPLE 2

The sodium xylene sulfonate content of Example 1 is increased to 2g (0.8% by weight of the composition). The resultant liquid exhibits a markedly reduced viscosity, is opaque, homogeneous and very light blue in color. This composition disperses as a cloud in 1000 ml of still tap water at 44° F., indicating excellent cold water dispersibility. The towel test gives a 10+ softness rating and a 2.4 *b* value for whiteness.

EXAMPLE 3

The sodium xylene sulfonate content of Example 1 is increased to 3g (1.2% by weight of the composition). The resultant liquid exhibits the same viscosity and appearance as in Example 2. This composition also shows excellent cold water dispersibility as in Example 2. A towel treated herewith gives a softness rating of 10+ and *b* value of 2.4.

EXAMPLE 4

The sodium xylene sulfonate of Example 1 is increased to 4 gms. (1.6% by weight). The composition has the same viscosity and appearance as in Example 2. The cold water dispersibility hereof is excellent. The towel test gives a rating of 10+ for softness and a +2.2 *b* value.

EXAMPLE 5

2 gms of a 43% solution of sodium cumene sulfonate (0.86% by weight) is substituted for the sodium xylene sulfonate of Example 1. This composition exhibits the same viscosity and appearance and cold water dispersibility as in Example 2. A towel treated herewith gives a 10+ softness rating and +2.1 *b* value.

EXAMPLE 6

2 gms of a 44% solution of sodium toluene sulfonate (0.88% by weight) is substituted for the sodium xylene sulfonate of Example 1. This composition exhibits the same viscosity, appearance, cold water dispersibility as in Example 2. A towel treated herewith gives a softness rating of 10+ and a *b* value of +2.2.

EXAMPLE 7

1 gm of a 47% slurry of linear tridecyl benzene sulfonate, sodium salt (0.47% by weight) is substituted for the sodium xylene sulfonate of Example 1. Small white granules appear when adding the sulfonate to the softener at room temperature, which disappear after stirring for about one-half hour. The resultant product is smooth, homogeneous, very fluid, and disperses very well in cold tap water (48° F.)

EXAMPLE 8

1000 gms of a softening composition is prepared from the following ingredients:

| | % |
|---|---|
| 2-heptadecyl-1-methyl-1-[(2-stearoylamido)ethyl] imidazolinium methyl sulfate-75% solution | 9.5 |
| Brightener of Example 1, 23% | 1.2 |
| Blue color, 1% | 1.5 |
| Sodium xylene sulfonate, 40% | 2.0 |
| Perfume | 0.5 |
| Water | 85.3 |

The sodium xylene sulfonate was added to the blue water and heated to about 120° F. The imidazolinium compound and the brightener were blended and heated to about 120° F. and added to the blue water. The liquid mixture was cooled to 100° F. and the perfume was added thereto. This composition was very fluid, opaque, lotion-like in appearance, and dispersed very rapidly in cold tap water (48° F.) and in water at a temperature of 120° F. and at 30° F.

These examples clearly illustrate the unusual beneficial results obtained by instant softening compositions which contain as an essential ingredient a minor, but critical, amount of an organic, anionic sulfonate detergent of the type described within about 0.4–2.0% by weight of the softening composition. The viscosity is greatly improved, rendering the liquid readily pourable; the homogeneity and stability are retained thereby ensuring uniform softening and the elimination of fabric staining. The most important features of this composition are its excellent cold water dispersibility and the retention of the superior softening performance of the cationic quaternary softeners.

Results similar to those described in the foregoing examples are obtained when the anionic sulfonate is replaced either wholly or partly (e.g. 1:1, 1:2, 2:1, 4:1, 1:4, 10:1, 1:10) with the paraffin and/or olefin sulfonates hereinbefore described.

EXAMPLE 9

Example 1 is repeated using the following cationic compounds in the indicated amounts in place of the imidazolinium compound of that example.

| | Cationic | Amount |
|---|---|---|
| Ex. 9A | distearyl dimethyl ammonium chloride | 6% |
| 9B | distearyl dimethyl ammonium chloride | 10% |
| 9C | diethyl octyl stearyl ammonium chloride | 7% |
| 9D | diethyl octyl stearyl ammonium bromide | 7.5% |
| 9E | diethyl octyl stearyl ammonium methosulfate | 8% |
| 9F | ditallow dimethyl ammonium iodide | 6.5% |
| 9G | ditallow dimethyl ammonium acetate | 9% |
| 9H | 2-coco-1-(hydroxyethyl)-1-stearyl imidazolinium chloride | 6% |
| 9I | 2-heptadecenyl-(hydroxyethyl)-1-stearyl imidazolinium chloride | 8% |
| 9J | 2-heptadecenyl-(hydroxyethyl)-1-ethylsulfate | 10% |

The results are comparable to Example 1.

EXAMPLE 10

Examples 1 and 9 are repeated with the following changes in ingredient concentration:

| Changes in Ex. 1 | Cationic | Sulfonate |
|---|---|---|
| 1 | 10% | 1% |
| 1 | 15% | 1.5% |
| 1 | 20% | 2% |
| 1 | 10% | 2% |
| 1 | 8% | 2% |

Instant softening compositions may also include minor amounts of brighteners, bluing, germicides, perfumes, and other additives which do not interfere with the superior cold water dispersibility and softening properties of the composition.

This product may be prepared in liquid or solid form, absorbed onto a carrier. The amount of quaternary softener present in the liquid composition is within the range of about 6 to 25% by weight. The liquid composition may be sprayed on, or otherwise agglomerated with particles of borax, sodium carbonate, sodium bicarbonate, sodium sesquicarbonate, sodium sulfate, sodium chloride, the phosphate salts of other carrier materials, to form granular or powdered compositions. This solid product may also be formed into pellets or other suitable shape. The amount of quaternary softener present in the powdered form may be 6–30% by weight.

Generally, it is prepared that the weight ratio of cationic softener to anionic sulfonate be from about 4:1 to 50:1, and more preferably from 5:1 to 40:1.

The invention has found its greatest utility thus far in the softening of cotton fabrics, fabrics made of other cellulosic fibers, e.g., rayon; or other textile fibers, e.g., nylon, silk, wool, polyethylene terephthalate, cellulose acetate, acrylonitrile polymers or copolymers, or blends of any two or more of these fibers (e.g., cotton-polyester blends). The softening composition may be applied to the fabric in an aqueous bath either as final rinse during laundering or as a separate and distinct softening operation. In use, 30–60gms of the softening composition is added to an automatic washing machine or similar treating bath containing 17 gallons (35 liters) of water and an average load of fabrics (about 6–8 pounds). However, lesser or greater amounts may be utilized to obtain the desired degree of softness and whiteness and, depending on the water temperature, the amount of water and clothes, etc.

While various preferred embodiments of the present invention have been illustrated by means of specific examples, it is to be understood that the present invention is in no way to be deemed as limited thereto, but should be construed as broadly as all or any equivalents thereof.

What is claimed is:

1. A stable, cold water dispersible fabric softening composition comprising from about 60 to 20% by weight of a cationic quaternary ammonium softener as the sole fabric softening agent, an organic, anionic sulfonate, the weight ratio of cationic softener to anionic detergent being from about 40:1 to 5:1, and wherein the anionic sulfonate is selected from the group consisting of:

1. an unsubstituted benzene or naphthalene sulfonate,
2. a mono-$C_1$ to $C_{20}$ alkyl substituted benzene or naphthalene sulfonate,
3. a polyalkyl substituted aromatic sulfonate with one alkyl group having a maximum of 18 carbons and each of the remaining alkyl groups having a maximum of 2 carbons and
4. olefin and paraffin sulfonates containing from about 8 to 20 carbon atoms, and mixtures thereof, and water.

2. A composition in accordance with claim 1, wherein the quaternary ammonium softener is an imidazolinium compound.

3. A composition in accordance with claim 2, wherein the quaternary ammonium compound is 2-heptadecyl-1-methyl-1-[(2-stearoylamido)ethyl] imidazolinium methyl sulfate.

4. A composition in accordance with claim 1, wherein one alkyl substituent on the benzene or naphthalene sulfonate contains 1–20 carbon atoms.

5. A composition in accordance with claim 4, wherein the sulfonate is sodium xylene sulfonate.

6. A composition in accordance with claim 4, wherein the sulfonate is sodium cumene sulfonate.

7. A composition in accordance with claim 4, wherein the sulfonate is sodium toluene sulfonate.

8. A method of softening fabrics which comprises applying to said fabric in an aqueous bath, an amount sufficient to soften the fabric, of the composition of claim 1.

9. The method of claim 8, wherein the aqueous bath is cold water.

* * * * *